US010844506B2

(12) United States Patent
Nunomura

(10) Patent No.: US 10,844,506 B2
(45) Date of Patent: Nov. 24, 2020

(54) ALUMINUM MEMBER AND METHOD OF MANUFACTURING THE SAME

(71) Applicant: UACJ Corporation, Tokyo (JP)

(72) Inventor: Junji Nunomura, Tokyo (JP)

(73) Assignee: UACJ Corporation, Tokyo (JP)

( * ) Notice: Subject to any disclaimer, the term of this patent is extended or adjusted under 35 U.S.C. 154(b) by 0 days.

(21) Appl. No.: 16/201,969

(22) Filed: Nov. 27, 2018

(65) Prior Publication Data

US 2019/0161881 A1 May 30, 2019

(30) Foreign Application Priority Data

Nov. 28, 2017 (JP) ..... 2017-227482

(51) Int. Cl.
*C25D 11/08* (2006.01)
*C25D 11/10* (2006.01)

(52) U.S. Cl.
CPC ..... *C25D 11/08* (2013.01); *C25D 11/10* (2013.01)

(58) Field of Classification Search
CPC ..... C25D 11/04; C25D 11/12
See application file for complete search history.

(56) References Cited

U.S. PATENT DOCUMENTS 4,310,586 A * 1/1982 Sheasby ..... C25D 11/12 205/105
5,811,917 A * 9/1998 Sekinger ..... H01J 9/025 313/309
7,578,921 B2 8/2009 Dolan
8,663,807 B2 3/2014 Dolan
2012/0000783 A1 1/2012 Suda et al.
2015/0090597 A1 4/2015 Tatebe et al.
2015/0090598 A1* 4/2015 Tatebe ..... C25D 11/045 205/50

(Continued)

FOREIGN PATENT DOCUMENTS

CN 1670263 A 9/2005
CN 101048538 B 9/2011

(Continued)

OTHER PUBLICATIONS

English language translation of JP S62-20895 A, generated on Aug. 27, 2019 with Espacenet website (https://www.epo.org/searching-for-patents/technical/espacenet.html#tab-1).*

(Continued)

*Primary Examiner* — Mark Ruthkosky
*Assistant Examiner* — Julia L Rummel
(74) *Attorney, Agent, or Firm* — Dorsey & Whitney LLP

(57) ABSTRACT

An aluminum member comprises a base material made of aluminum or art aluminum alloy, and an anodized coating provided on a surface of the base material and having a thickness of 100 μm or less. The anodized coating comprises a barrier layer formed on the surface of the base material and having a thickness of 10 to 150 nm, and a porous layer formed on the barrier layer and having a thickness of 6 μm or more. The porous layer comprises a first pore extending in a thickness direction of the porous layer from a boundary between the porous layer and the barrier layer, and a second pore connected to the first pore and extending so as to branch radially in the thickness direction of the porous layer toward a surface of the porous layer.

4 Claims, 4 Drawing Sheets

(56) References Cited

U.S. PATENT DOCUMENTS

| | | | | |
|---|---|---|---|---|
| 2015/0225867 | A1 | 8/2015 | Tatebe et al. | |
| 2017/0044684 | A1 | 2/2017 | Tatebe et al. | |
| 2017/0121836 | A1* | 5/2017 | Tatebe | C25D 11/16 |

FOREIGN PATENT DOCUMENTS

| | | | | |
|---|---|---|---|---|
| CN | 105492662 | A | | 4/2016 |
| CN | 106757265 | A | | 5/2017 |
| JP | S49079333 | A | | 7/1974 |
| JP | S53087945 | A | | 8/1978 |
| JP | S56003695 | A | | 1/1981 |
| JP | S60138094 | A | | 7/1985 |
| JP | S6220896 | A | * | 1/1987 |
| JP | H03100145 | A | | 4/1991 |
| JP | 2003171794 | A | | 6/2003 |
| JP | 2017025384 | A | | 2/2017 |
| JP | 2017075383 | A | | 4/2017 |
| JP | 2017122267 | A | | 7/2017 |
| TW | 201522716 | A | | 6/2015 |
| WO | 2010073916 | A | | 7/2010 |
| WO | 2015132297 | A1 | | 9/2015 |

OTHER PUBLICATIONS

English language translation of JP S60-138094 A, generated on Aug. 27, 2019 with Espacenet website (https://www.epo.org/searching-for-patents/technical/espacenet.html#tab-1).*

Chozo Yoshimura and Hiroshi Kakuno, "A Method of Repetitive Flash Anodizing of Aluminum with Momentary High Current at Electroless State in Acid bath," vol. 44, No. 2, 1993.

English Translation of Notice of decision of rejection issued in the priority application, JP 2017-227482 (dated Aug. 20, 2018).

English Translation of Notice of reason for rejection issued in the priority application, JP 2017-227482 (dated Apr. 16, 2018).

Ken Ebihara, "Aluminum Decorative Anodizing Technology—Mainly Whitening-," vol. 67, No. 5, 2016.

English Translation of Decision to Grant a Patent in a corresponding Japanese application No. 2017-227482 (dated Jan. 7, 2019).

English Translation of Office Action dated Sep. 1, 2019 in the KR application No. 10-2018-0144114.

English translation of Office Action for CN Application No. 201811435098.8, dated Oct. 8, 2019.

Office Action in the corresponding TW application No. 107142192, dated Aug. 7, 2019.

Zhang, Yansong et al., "Whitening and Finishing of Aluminum Surfaces", Surface Technology, vol. 26, No. 5, May 1999, pp. 6-18.

English translation of Decision to Grant Patent in KR application No. 10-2018-0144114, dated Mar. 1, 2020.

English translation of second Office Action for CN Application No. 201811435098.8, dated Mar. 4, 2020.

English translation of Notification to Grant Patent Right for Invention for CN Application No. 201811435098.8, dated Aug. 27, 2020.

* cited by examiner

[Figure 2]
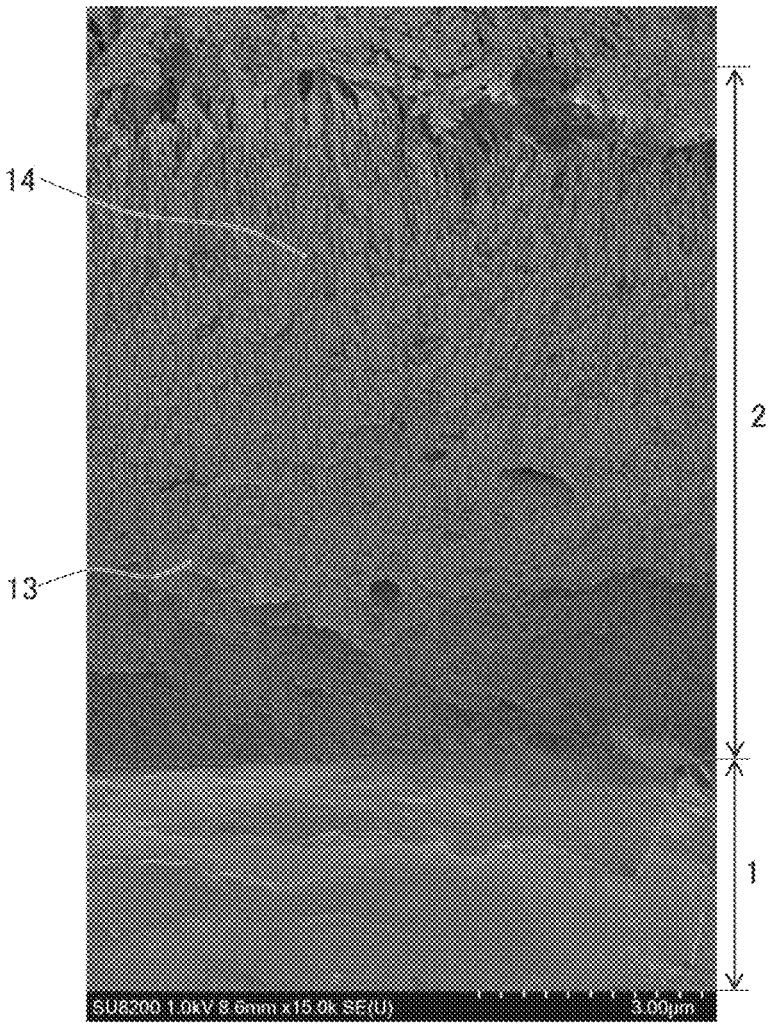

[Figure 3]
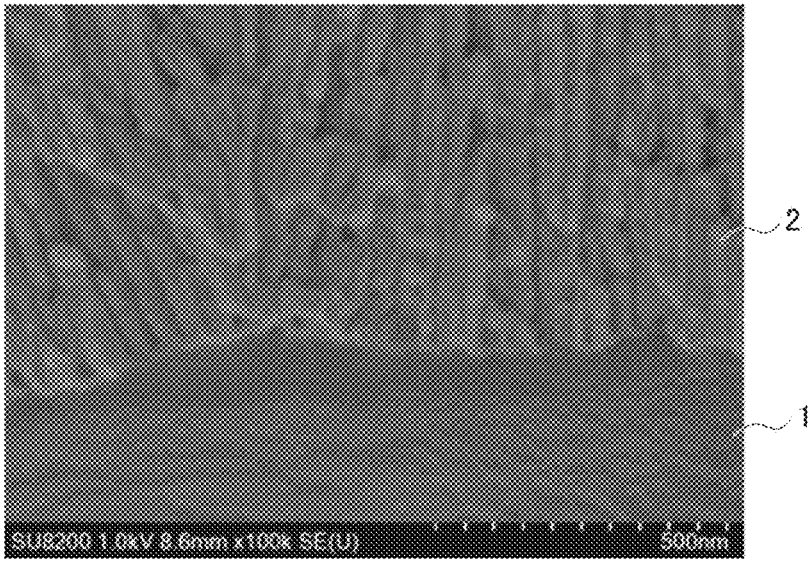

[Figure 4]
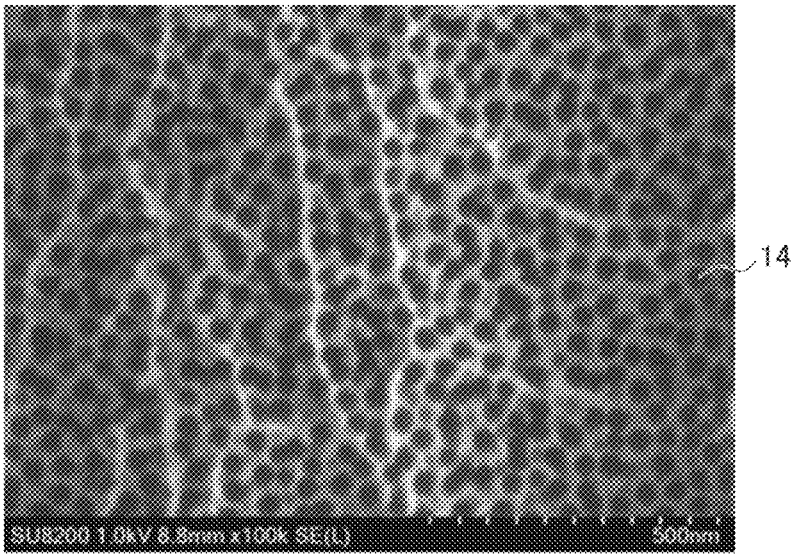

ALUMINUM MEMBER AND METHOD OF MANUFACTURING THE SAME

CROSS REFERENCE TO RELATED APPLICATIONS

This application claims the benefit of Japanese Patent Application No. 2017-227482, filed on Nov. 28, 2017, the full contents of which is hereby incorporated by reference in its entirety for any purpose.

BACKGROUND

Technical Field

The present disclosure relates to an aluminum member and a method of manufacturing the aluminum member.

Background Art

Aluminum members with opaque, white color have been demanded for applications requiring aesthetic properties such as for building materials or casings of electronic devices. Opaque, white color is a color difficult to achieve by common dyeing and coloring methods used in anodization of aluminum members. Thus, methods of manufacturing aluminum members with opaque, white color have been conventionally proposed. Japanese Patent Application Laid-Open No. 53-087945 discloses a method of manufacturing an aluminum member with opaque, white color by performing barrier anodization and then performing porous anodization involving current recovering to change a coating structure. Japanese Patent Application Laid-Open No. 2017-25384 discloses a method of coloring an aluminum member by filling a pigment into fine pores formed by anodization.

SUMMARY

However, the conventional methods of manufacturing aluminum members with opaque, white color have entailed a complicated electrolytic process, such as entailing secondary or more treatment steps. There has been also a facility-related disadvantage such as having to make a large amount of facility investment required for alternate current electrolysis. Moreover, the conventional methods of manufacturing aluminum members could not have provided aluminum members having a sufficient degree of whiteness.

The present disclosure provides an aluminum member having a high degree of whiteness and obtainable by a primary treatment simpler than conventional treatments and provides a method of manufacturing the aluminum member.

The present disclosure presents the following embodiments.

[1] An aluminum member comprising:

a base material made of aluminum or an aluminum alloy; and an anodized coating provided on a surface of the base material and having a thickness of 100 μm or less, wherein the anodized coating comprises a barrier layer formed on the surface of the base material and having a thickness of 10 to 150 nm, and a porous layer formed on the barrier layer and having a thickness of 6 μm or more, and the porous layer comprises a first pore extending in a thickness direction of the porous layer from a boundary between the porous layer and the barrier layer; and a second pore connected to the first pore and extending so as to branch radially in the thickness direction of the porous layer toward a surface of the porous layer.

[2] The aluminum member according to [1], wherein an angle of the second pore with the surface of the base material is 30 to 85 degrees.

[3] The aluminum member according to [1], wherein a brightness by Hunter of the aluminum member, as measured from a surface of the anodized coating, is 70 to 90.

[4] The aluminum member according to [1], wherein an average diameter of the first pore is 10 to 150 nm, and an average spacing between the first pores adjacent to each other is 25 to 400 nm.

[5] A method of manufacturing an aluminum member, comprising:

preparing a base material made of aluminum or an aluminum alloy; and performing anodization on the base material in an electrolytic solution under conditions where a current density is 5 to 30 $mA \cdot cm^{-2}$ and a temperature of the electrolytic solution is 0 to 80° C., the electrolytic solution comprising: a first acid or a salt of the first acid at a concentration of 0.01 to 2.0 $mol \cdot dm^{-3}$, the first acid being selected from the group consisting of an inorganic acid and an organic carboxylic acid; and a second acid at a concentration of 0.01 to 5.0 $mol \cdot dm^{-3}$, the second acid being an acid anhydride.

[6] The method of manufacturing an aluminum member according to [5], wherein the second acid is at least one acid anhydride selected from the group consisting of diphosphoric acid, triphosphoric acid, and polyphosphoric acid.

[7] The method of manufacturing an aluminum member according to [5], wherein the aluminum member comprises:

a base material made of aluminum or an aluminum alloy; and an anodized coating provided on a surface of the base material and having a thickness of 100 μm or less, wherein the anodized coating comprises a barrier layer formed on the surface of the base material and having a thickness of 10 to 150 nm, and a porous layer formed on the barrier layer and having a thickness of 6 μm or more, and the porous layer comprises a first pore extending in a thickness direction of the porous layer from a boundary between the porous layer and the barrier layer; and a second pore connected to the first pore and extending so as to branch radially in the thickness direction of the porous layer toward a surface of the porous layer.

[8] An aluminum member manufactured by the method of manufacturing an aluminum member according to [5].

It is possible to provide an aluminum member having a high degree of whiteness and obtainable by a primary treatment simpler than conventional treatments and provide a method of manufacturing the aluminum member.

BRIEF DESCRIPTION OF THE DRAWINGS

FIG. 2 is a photograph taken with a scanning electron microscope (SEM) of a cross-section of an anodized coating in Example 3;

FIG. 3 is a photograph taken with a scanning electron microscope (SEM) of a cross-section at the boundary between art anodized coating and base material in Example 3; and FIG. 4 is a photograph taken with a scanning electron microscope (SEM) of a surface of a porous layer in Example 3.

DETAILED DESCRIPTION

1. Aluminum Member

Figure 1A:
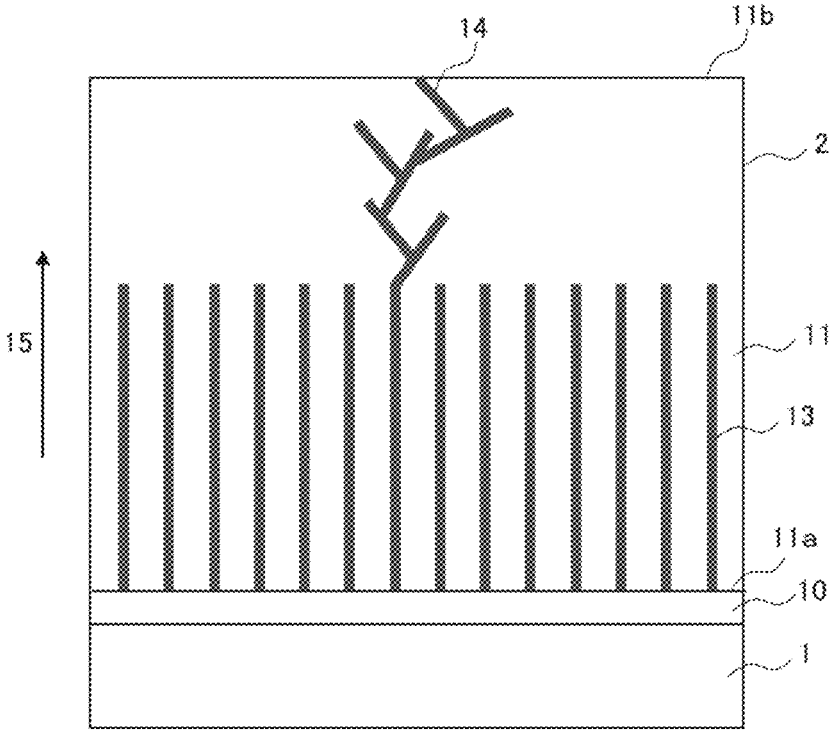
FIG. 1A is a diagram schematically showing an aluminum member according to one embodiment.

An aluminum member comprises a base material and an anodized coating provided on a surface of the base material. Hereinafter, the components constituting the aluminum member according to one embodiment will be described.

(Base Material)

The base material may be made of aluminum or may be made of an aluminum alloy. The material of the base material can be selected as appropriate depending on the intended use of the aluminum member. For example, from the viewpoint of increasing the strength of the aluminum member, it is preferable to use 5000 series aluminum alloy or 6000 series aluminum alloy for the base material. From the viewpoint of increasing the degree of whiteness achieved after anodization, it is preferable to use, for the base material, 1000 series or 6000 series aluminum alloy resistant to coloring due to anodization.

(Anodized Coating)

The anodized coating comprises: a barrier layer formed on the surface of the base material and having a thickness of 10 to 150 nm; and a porous layer formed on the barrier layer and having a thickness of 6 μm or more. The anodized coating has a thickness of 100 μm or less as a whole. If the thickness of the anodized coating is more than 100 μm, the electrolysis time is lengthened, resulting in reducing the production efficiency and generating unevenness due to heterogeneous growth, which thus causes appearance defect. It is preferable that the anodized coating has a thickness of 80 μm or less as a whole.

The barrier layer can prevent coloring by interference and increase the degree of whiteness due to having a thickness of 10 to 150 nm.

The porous layer has a thickness of 6 μm or more. If the thickness of the porous layer is less than 6 μm, since diffusion of light by irregular reflection is insufficient, the anodized coating is likely to become transparent. It is not preferable that the anodized coating becomes transparent, because in this case the color of the aluminum member becomes similar to the color of the base material. It is preferable that the thickness of the porous layer is 6 μm or more and less than 100 μm, more preferably 8 to 75 μm, even more preferably 10 to 50 μm.

The porous layer comprises first and second pores. The first pore extends in a thickness direction of the porous layer from the boundary between the porous layer and the barrier layer. Thus, the first pore is positioned on the barrier layer side of the porous layer (at and in the vicinity of the boundary between the porous layer and the barrier layer) and extends in the thickness direction of the porous layer (a direction approximately perpendicular to the surface of the base material).

The second pore is connected to the first pore and extends so as to branch radially in the thickness direction of the porous layer toward a surface of the porous layer. That is, the second pore is present in such a manner that one or more pores branching from one pore extend over a given angular range; namely, with decreasing distance to the surface of the porous layer, one or more pores branching from one pore at given angles extend and, from each of the branching pores, one or more pores further branching at given angles extend. The second pore extends in the thickness direction of the porous layer toward the surface of the porous layer while spreading in an inverted dendritic pattern. Thus, the second pore is positioned on the surface side of the porous layer (at and in the vicinity of the surface of the porous layer). The "surface of the porous layer" refers to one of the two opposite faces of the porous layer that is opposite to the face in contact with the barrier layer. When the porous layer is viewed in a cross-section parallel to the thickness direction, the first pore and the second pore are arranged in order from the base material side to the surface side of the porous layer. The aluminum member according to one embodiment, due to having the second pore in the porous layer, allows light entering the porous layer to be diffused by irregular reflection; thus, the degree of whiteness of the aluminum member can be increased.

The angle of the second pore with the surface of the base material is preferably 30 to 85 degrees, more preferably 35 to 80 degrees, even more preferably 40 to 75 degrees. The angle of the second pore with the surface of the base material is measured according to procedure described in examples. More specially, measurement is conducted using results obtained by observing the surface and cross-section of the anodized coating with a FE-SEM (SU-8230, manufactured by Hitachi, Ltd.). In the cross-sectional observation, a crack caused in the coating by bending the sample subjected to anodization in a V-shape is observed at an angle to the crack. A perpendicular line and parallel line defined by the origin of branching, the first pore including the origin of branching, and the base material surface are drawn through the origin of branching, the angle of the second pore with the parallel line is determined, and the average of values determined at 10 randomly selected points in the field of view of a SEM image is defined as the angle of the second pore with the surface of the base material. In this case, the base material surface is parallel to the parallel line. When the angle of the second pore with the surface of the base material is 30 degrees or more, light entering the porous layer is less likely to be transmitted, resulting in making the anodized coating become opaque. When the angle of the second pore with the surface of the base material is 85 degrees or less, diffusion of light by irregular reflection occurs to a sufficient extent, resulting in making the anodized coating become opaque.

FIG. 1A is a schematic diagram showing an aluminum member according to one embodiment. As shown in FIG. 1A, an anodized coating 2 is formed on a surface of a base material 1 made of aluminum or art aluminum alloy. The anodized coating 2 comprises a barrier layer 10 and a porous layer 11. The porous layer 11 has two opposite faces (a boundary face 11*a* in contact with the barrier layer 10 and a surface 11*b* opposite to the face 11*a*). On the barrier layer side of the porous layer 11, the first pore 13 extending in a direction 15 from the face 11*a* to the surface 11*b* is positioned. On the surface 11*b* side of the porous layer, the second pore 14 is positioned. The second pore 14 is present in such a manner as to be connected to each of the first pores 13; however, only some of the second pores 14 are schematically shown in FIG. 1A. The second pore 14 extends while spreading radially in the direction 15 toward the surface lib and forms an inverted dendritic pattern.

Figure 1B:
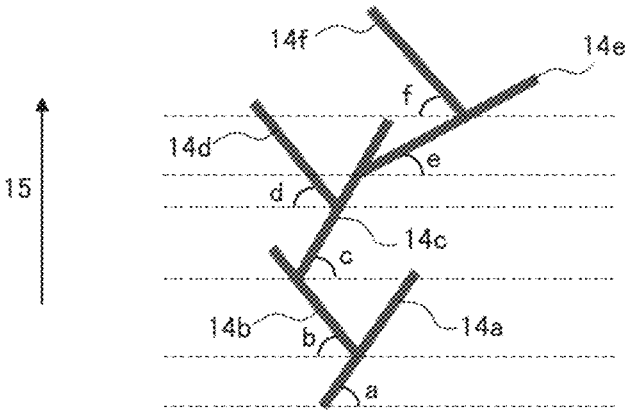
FIG. 1B is an enlarged diagram of a portion of FIG. 1A.

FIG. 1B is an enlarged diagram showing the second pores 14. As shown in FIG. 1B, a second pore 14*b* branching from a second pore 14*a* is present, and a second pore 14*c* branching from the second pore 14*b* is present. Furthermore, second pores 14*d* to 14*f* branching from the second pore 14*c* are present. The second pores 14 extend so as to spread radially in the direction 15 in this manner, and the second pores 14 have an inversed dendritic pattern when viewed in a cross-section parallel to the thickness direction of the porous layer. As shown in FIG. 1B, the angles of the second pores 14*a* to 14*f* with the surface of the base material are represented as the angles a to f between the dotted lines and the second pores 14*a* to 14*f*. The angle between the second pore and the base material is defined as acute angles and are 85 degrees or less. When the angle between a pore in the porous layer and the surface of the base material is more than 85 degrees and not more than 90 degrees, the pore is not classified as the second pore even if the pore branches off.

The first pore is preferably distributed over a thickness of 5 μm or more in the porous layer provided on the surface of the base material. When the first pore is distributed over a thickness of 5 μm or more in the porous layer, light passes through the coating, so that decrease in degree of whiteness due to metallic gloss of the base material can be inhibited.

The second pore is preferably distributed over a thickness of 1 μm or more in the porous layer. When the second pore is distributed over a thickness of 1 μm or more in the porous layer, irregular reflection of light is enhanced, so that the degree of whiteness can be increased.

The brightness by Hunter of the aluminum member, as measured from the surface of the anodized coating, is preferably 70 to 90, more preferably 75 to 90, even more preferably 80 to 90. The "brightness by Hunter" refers to a numerical value obtained according to JIS P 8123. The higher the brightness by Hunter is, the higher the whiteness is. When the brightness by Hunter of the aluminum member is 70 to 90, the aluminum member has favorable opaque, white color and can have good aesthetic properties.

The average diameter of the first pore is preferably 10 to 150 nm, and the average spacing between the first pores adjacent to each other is also preferably 25 to 400 nm. When the average diameter of the first pore is 10 to 150 nm and the average spacing between the first pores adjacent to each other is 25 to 400 nm, light entering the porous layer can be more effectively diffused, so that the transparency of the anodized coating can be further reduced. Consequently, the degree of whiteness of the aluminum member can be further increased.

2. Method of Manufacturing Aluminum Member

A method of manufacturing an aluminum member according to one embodiment comprises preparing a base material and performing anodization on the base material. To accomplish anodization, it is conventionally necessary to perform a primary treatment and a secondary treatment using an electrolytic solution different from that used in the primary treatment. In some cases, it may be necessary to further perform tertiary or more treatments using different electrolytic solutions. By contrast, with the method of manufacturing an aluminum member according to one embodiment, an aluminum member having a high degree of whiteness can be provided by a primary treatment simpler than conventional treatments. Hereinafter, each step will be described in detail.

(Preparing of Base Material)

First, a base material made of aluminum or an aluminum alloy is prepared. Examples of the aluminum alloy include, but are not limited to, 1000 series aluminum alloy, 5000 series aluminum alloy, and 6000 series aluminum alloy.

(Performing of Anodization on Base Material)

The conditions of the anodization are set to conditions allowing the formation of an anodized coating comprising: a barrier layer on a surface of the base material and having a thickness of 10 to 150 nm; and a porous layer on the barrier layer, having a thickness of 6 μm or more, and comprising first and second pores. The first pore is a pore positioned on the barrier layer side and extending in the thickness direction of the porous layer. The second pore is a pore positioned on the surface side of the porous layer and extending so as to branch radially in the thickness direction of the porous layer toward the surface of the porous layer.

A surface treatment such as degreasing or polishing may be perforated on the base material as necessary prior to the anodization. For example, when alkaline degreasing is performed as the surface treatment, the gloss value of the anodized coating can be reduced to obtain an aluminum member exhibiting a white color without luster. When polishing such as chemical polishing, mechanical polishing, or electrolytic polishing is performed as the surface treatment, the gloss value achieved after the anodization can be increased to obtain an aluminum member exhibiting a white color with luster. From the viewpoint of further increasing the degree of whiteness and gloss value of the resulting aluminum member, electrolytic polishing is preferably performed on the base material before the anodization.

For the anodization, an electrolytic solution is used which comprises: a first acid or a salt of the first acid at a concentration of 0.01 to 2.0 $mol \cdot dm^{-3}$, the first acid being selected from the group consisting of an inorganic acid and an organic carboxylic acid; and a second acid at a concentration of 0.01 to 5.0 $mol \cdot dm^{-3}$, the second acid being an acid anhydride. The first acid selected from the group consisting of an inorganic acid and an organic carboxylic acid, or the salt of the first acid, has the effect of causing the formation and dissolution of a coating on depressions in the surface of the barrier layer and forming a pore extending in a thickness direction of the coating. On the other hand, the second acid as an acid anhydride has the effect of forming a structure extending in a fibrous form on the wall surfaces of the depressions. It is therefore considered that in the method of manufacturing an aluminum member according to one embodiment, the use of the electrolytic solution comprising the first acid or the salt of the first acid and the second acid allows these substances to act synergistically to form the porous layer comprising the first and second pores.

Examples of the inorganic acid as the first acid and salts of the inorganic acid include, but are not limited to, at least one substance selected from the group consisting of sulfuric acid, phosphoric acid, salt of a phosphoric acid, oxalic acid, salt of an oxalic acid, chromic acid, and salt of a chromic acid.

Examples of the organic carboxylic acid as the first acid and salts of the organic carboxylic acid include a cyclic oxocarboxylic acid, tartaric acid, maleic acid, and salts of these acids. The cyclic oxocarboxylic acid is preferably croconic acid, rhodizonic acid, or squaric acid.

Examples of the acid anhydride as the second acid include, but are not limited to, at least one substance selected from the group consisting of trimellitic anhydride, phthalic anhydride, maleic anhydride, pyromellitic anhydride, diphosphoric acid, triphosphoric acid, and polyphosphoric acid. It is preferable to use, among these acid anhydrides, at least one substance selected from the group consisting of diphosphoric acid, triphosphoric acid, and polyphosphoric acid in order to allow reliable formation of the second pore regularly shaped.

The concentration of the first acid and the salt of the first acid in the electrolytic solution is set to 0.01 to 2.0 $mol \cdot dm^{-3}$. If the concentration of the first acid and the salt of the first acid is lower than 0.01 $mol \cdot dm^{-3}$, the anodization of the base material cannot be effectively accomplished, and if the concentration is higher than 2.0 $mol \cdot dm^{-3}$, the dissolving power of the electrolytic solution is increased, so that it becomes difficult to grow a coating in the form of the porous layer. The concentration of the first acid and the salt of the first acid in the electrolytic solution is preferably set to 0.05 to 1.5 mol·dm$^{-3}$.

The concentration of the second acid in the electrolytic solution is set to 0.01 to 5.0 mol·dm$^{-3}$. If the concentration of the second acid is lower than 0.01 mol·dm$^{-3}$, it is difficult to form the second pore in the porous layer, and if the concentration is higher than 5.0 mol·dm$^{-3}$, the second pore cannot be periodically formed, and the porous layer becomes thin. Thus, when the concentration of the second acid is set to 0.01 to 5.0 mol·dm$^{-3}$, the porous layer can be sufficiently grown to a certain thickness, and the second pore can be formed periodically in the porous layer, so that the degree of whiteness of the aluminum member can be increased.

The current density during the anodization is set to 5 to 30 mA·cm$^{-2}$. The current density during the anodization is preferably set to 5 to 20 mA·cm$^{-2}$, more preferably to 10 to 20 mA·cm$^{-2}$. When the current density is set to 5 mA·cm$^{-2}$ or more, the rate of growth of the porous layer can be increased to achieve a sufficient coating thickness. When the current density is set to 30 mA·cm$^{-2}$ or less, the anodic oxidation reaction proceeds uniformly, so that the occurrence of discoloration or white color unevenness can be prevented.

The temperature of the electrolytic solution during the anodization is set to 0 to 80° C. The temperature of the electrolytic solution during the anodization is preferably 20° C. to 60° C. When the temperature of the electrolytic solution is 0° C. or higher, the second pore can be easily formed, and when the temperature of the electrolytic solution is 0° C. or lower, the porous layer is dissolved at a moderate rate to make a coating thickness become thick, so that the degree of whiteness of the aluminum member can be increased.

Additionally, the electrolysis time during the anodization is preferably 10 to 600 minutes, more preferably 20 to 300 minutes, even more preferably 30 to 120 minutes. When the electrolysis time is 10 minutes or more, the coating thickness is increased, and when the electrolysis time is 600 minutes or less, the production efficiency can be improved.

Post-treatment such as pore sealing may, if necessary, be performed after the anodization is performed on the base material.

EXAMPLES

Hereinafter, the present disclosure will be described in detail based on Examples. The present disclosure is not limited to the examples presented below, and modifications can be made as appropriate without departing from the gist of the present disclosure.

Base materials made of aluminum alloys listed in Tables 1 and 2 below were prepared, and anodization was performed on the base materials under the conditions listed in Tables 1 and 2 to produce aluminum members of Examples 1 to 31 and Comparative Examples 1 to 11.

TABLE 1

| | Base material (Type of aluminum alloy) | Type of surface treatment | First acid or salt of first acid | Concentration of first acid or salt of first acid (mol · dm$^{-3}$) | Second acid | Concentration of second acid (mol · dm$^{-3}$) | Temperature of electrolytic solution (° C.) | Current density during anodization (mA · cm$^{-2}$) | Electrolysis time (minutes) |
|---|---|---|---|---|---|---|---|---|---|
| Example 1 | 1100 | Alkaline degreasing | Sulfuric acid | 0.01 | Diphosphoric acid | 0.2 | 20 | 10 | 60 |
| Example 2 | 1100 | Alkaline degreasing | Sulfuric acid | 0.05 | Diphosphoric acid | 0.2 | 20 | 10 | 60 |
| Example 3 | 1100 | Alkaline degreasing | Sulfuric acid | 0.5 | Diphosphoric acid | 0.2 | 20 | 10 | 60 |
| Example 4 | 1100 | Alkaline degreasing | Sulfuric acid | 1.5 | Diphosphoric acid | 0.2 | 20 | 10 | 60 |
| Example 5 | 1100 | Alkaline degreasing | Sulfuric acid | 2 | Diphosphoric acid | 0.2 | 20 | 10 | 60 |
| Example 6 | 1100 | Alkaline degreasing | Sulfuric acid | 0.5 | Diphosphoric acid | 0.01 | 20 | 10 | 60 |
| Example 7 | 1100 | Alkaline degreasing | Sulfuric acid | 0.5 | Diphosphoric acid | 0.1 | 20 | 10 | 60 |
| Example 8 | 1100 | Alkaline degreasing | Sulfuric acid | 0.5 | Diphosphoric acid | 2.5 | 20 | 10 | 60 |
| Example 9 | 1100 | Alkaline degreasing | Sulfuric acid | 0.5 | Diphosphoric acid | 5 | 20 | 10 | 60 |
| Example 10 | 1100 | Alkaline degreasing | Sulfuric acid | 0.5 | Diphosphoric acid | 0.2 | 0 | 10 | 60 |
| Example 11 | 1100 | Alkaline degreasing | Sulfuric acid | 0.5 | Diphosphoric acid | 0.2 | 40 | 10 | 60 |
| Example 12 | 1100 | Alkaline degreasing | Sulfuric acid | 0.5 | Diphosphoric acid | 0.2 | 60 | 10 | 60 |
| Example 13 | 1100 | Alkaline degreasing | Sulfuric acid | 0.5 | Diphosphoric acid | 0.2 | 80 | 10 | 60 |
| Example 14 | 1100 | Alkaline degreasing | Sulfuric acid | 0.5 | Diphosphoric acid | 0.2 | 20 | 5 | 60 |
| Example 15 | 1100 | Alkaline degreasing | Sulfuric acid | 0.5 | Diphosphoric acid | 0.2 | 20 | 20 | 60 |
| Example 16 | 1100 | Alkaline degreasing | Sulfuric acid | 0.5 | Diphosphoric acid | 0.2 | 20 | 30 | 60 |
| Example 17 | 1100 | Chemical polishing | Sulfuric acid | 0.5 | Diphosphoric acid | 0.2 | 20 | 10 | 60 |
| Example 18 | 1100 | Mechanical polishing | Sulfuric acid | 0.5 | Diphosphoric acid | 0.2 | 20 | 10 | 60 |

TABLE 1-continued

| | Base material (Type of aluminum alloy) | Type of surface treatment | First acid or salt of first acid | Concentration of first acid or salt of first acid (mol · dm$^{-3}$) | Second acid | Concentration of second acid (mol · dm$^{-3}$) | Temperature of electrolytic solution (° C.) | Current density during anodization (mA · cm$^{-2}$) | Electrolysis time (minutes) |
|---|---|---|---|---|---|---|---|---|---|
| Example 19 | 1100 | Electrolytic polishing | Sulfuric acid | 0.5 | Diphosphoric acid | 0.2 | 20 | 10 | 60 |
| Example 20 | 6063 | Alkaline degreasing | Sulfuric acid | 0.5 | Diphosphoric acid | 0.2 | 20 | 10 | 60 |
| Example 21 | 1100 | Alkaline degreasing | Sulfuric acid | 1.5 | Diphosphoric acid | 0.2 | 20 | 20 | 10 |
| Example 22 | 1100 | Akaline degreasing | Sulfuric acid | 0.5 | Diphosphoric acid | 0.2 | 20 | 10 | 30 |
| Example 23 | 1100 | Alkaline degreasing | Sulfuric acid | 0.5 | Diphosphoric acid | 0.2 | 0 | 20 | 600 |
| Example 24 | 1100 | Alkaline degreasing | Phosphoric acid | 0.5 | Diphosphoric acid | 0.2 | 60 | 10 | 60 |
| Example 25 | 1100 | Alkaline degreasing | Salt of phosphoric acid | 0.5 | Diphosphoric acid | 0.2 | 60 | 10 | 60 |
| Example 26 | 1100 | Alkaline degreasing | Oxalic acid | 0.5 | Diphosphoric acid | 0.2 | 60 | 10 | 60 |
| Example 27 | 1100 | Alkaline degreasing | Salt of oxalic acid | 0.5 | Diphosphoric acid | 0.2 | 60 | 10 | 60 |
| Example 28 | 1100 | Alkaline degreasing | Chromic acid | 0.5 | Diphosphoric acid | 0.2 | 60 | 10 | 60 |
| Example 29 | 1100 | Alkaline degreasing | Salt of chromic acid | 0.5 | Diphosphoric acid | 0.2 | 60 | 10 | 60 |
| Example 30 | 1100 | Alkaline degreasing | Sulfuric acid | 0.5 | Triphosphoric acid | 0.2 | 60 | 10 | 60 |
| Example 31 | 1100 | Alkaline degreasing | Sulfuric acid | 0.5 | Polyphosphoric acid | 0.2 | 60 | 10 | 60 |

TABLE 2

| | Base material (Type of aluminum alloy) | Type of surface treatment | First acid or salt of first acid | Concentration of first acid or salt of first acid (mol · dm$^{-3}$) | Second acid | Concentration of second acid (mol · dm$^{-3}$) | Temperature of electrolytic solution (° C.) | Current density during anodization (mA · cm$^{-2}$) | Electrolysis time (minutes) |
|---|---|---|---|---|---|---|---|---|---|
| Comparative Example 1 | 1100 | Alkaline degreasing | — | — | — | — | — | — | 5 |
| Comparative Example 2 | 1100 | Alkaline degreasing | Sulfuric Acid | 0.005 | Diphosphoric acid | 0.2 | 20 | 10 | 60 |
| Comparative Example 3 | 1100 | Alkaline degreasing | Sulfuric Acid | 5 | Diphosphoric acid | 0.2 | 20 | 10 | 60 |
| Comparative Example 4 | 1100 | Alkaline degreasing | Sulfuric Acid | 0.5 | Diphosphoric acid | 0.005 | 20 | 10 | 60 |
| Comparative Example 5 | 1100 | Alkaline degreasing | Sulfuric Acid | 0.5 | Diphosphoric acid | 10 | 20 | 10 | 60 |
| Comparative Example 6 | 1100 | Alkaline degreasing | Sulfuric Acid | 0.5 | Diphosphoric acid | 0.2 | −10 | 10 | 60 |
| Comparative Example 7 | 1100 | Alkaline degreasing | Sulfuric Acid | 0.5 | Diphosphoric acid | 0.2 | 90 | 10 | 60 |
| Comparative Example 8 | 1100 | Alkaline degreasing | Sulfuric Acid | 0.5 | Diphosphoric acid | 0.2 | 20 | 1 | 60 |
| Comparative Example 9 | 1100 | Alkaline degreasing | Sulfuric Acid | 0.5 | — | — | 20 | 10 | 60 |
| Comparative Example 10 | 1100 | Alkaline degreasing | Phosphoric acid | 0.05 | — | — | 20 | 10 | 60 |
| Comparative Example 11 | 1100 | Alkaline degreasing | Sulfuric Acid | 0.5 | Phosphoric acid | 0.05 | 20 | 10 | 60 |

For the aluminum members of Examples 1 to 31 and Comparative Examples 1 to 11 produced according to Tables 1 and 2 above, various properties were measured as shown in Tables 3 to 6 below. The examination for the degree of whiteness, appearance defect, and coating structure was conducted as follows.

<Brightness by Hunter>

L*a*b* as standardized by International Commission on Illumination (CIE) and specified in JIS Z 8781-4: 2013 were measured with a colorimeter, and evaluation was made using a brightness by Hunter calculated by the following equation.

$$\text{Brightness by Hunter}=100-\{(100-L^*)^2+a^{*2}+b^{*2}\}^{1/2}$$

<White Color Unevenness>

Samples subjected to anodization were visually examined for the appearance: A sample uniformly anodized was rated "Good", a sample with slight white color unevenness was rated "Average", and a sample suffering considerable white color unevenness or not anodized was rated "Poor".

<Examination of Structure of Anodized Coating>

The thickness of the anodized coating was measured by embedding a cross-section of the anodized coating in a resin, subjecting the cross-section to mirror polishing, and observing the resulting sample with an optical microscope.

For the thickness of the barrier layer, the thickness of the porous layer, the thickness of the portion having the first pore in the porous layer, the thickness of the portion having the second pore in the porous layer, the angle of the second pore with the base material surface, the average diameter of the first pore, and the average spacing between the first pores adjacent to each other, measurement was conducted using results obtained by observing the surface and cross-section of the anodized coating with a FE-SEM (SU-8230, manufactured by Hitachi, Ltd.). In the cross-sectional observation, a crack caused in the coating by bending the sample subjected to anodization in a V-shape was observed at an angle to the crack.

More specifically, the thickness of the porous layer, the thickness of the portion having the first pore in the porous layer, the thickness of the portion having the second pore in the porous layer, and the angle of the second pore with the base material surface were measured from a continuous cross-sectional photograph as shown in FIG. 2 of the anodized coating and base material. A point at which the anodized coating grown vertically with respect to the base material surface began branching as shown in the schematic diagrams of FIGS. 1A and 1B was defined as an origin of branching, and the thickness from the origin to the base material Was defined as the thickness of the portion having the first pore. The average of values measured based on first pore at 10 randomly selected points in the field of view of a SEM image was finally determined as the thickness of the portion having the first pore. The thickness from the origin of branching to the surface of the anodized coating was determined as the thickness of the portion having the second pore. The average of values measured based on second pore at 10 randomly selected points in the field of view of a SEM image was finally determined as the thickness of the portion having the second pore. The sum of the thus determined thicknesses of the portion having the first pore and the portion having the second pore was defined as the thickness of the porous layer. For the angle of the second pore with the base material surface, a perpendicular line and parallel line defined by the origin of branching, the first pore including the origin of branching, and the base material surface were drawn through the origin of branching, the angle of the second pore with the parallel line was determined, and the average of values determined at 10 randomly selected points in the field of view of a SEM image was defined as the angle of the second pore with the base material surface.

The thickness of the barrier layer was measured by observing the interface as shown in FIG. 3 between the base material and anodized coating at a high magnification. The thickness of the barrier layer was determined at 10 randomly selected points in the field of view of a SEM image, and the average of the determined values was defined as the barrier layer thickness. The thickness of the anodized coating was defined as the sum of the thickness of the barrier layer and the thickness of the porous layer.

For the average diameter of the first pore, the size of the pore was measured at 10 randomly selected points in the field of view of a SEM image, and the average of the measured values was defined as the average diameter of the first pore. The spacing between the pores was measured at 10 randomly selected points in the same SEM image, and the average of the measured values was defined as the average spacing between the first pores adjacent to each other.

TABLE 3

| | Anodized coating | | | | | | | |
|---|---|---|---|---|---|---|---|---|
| Test sample | Thickness of barrier layer (nm) | Thickness of portion having first pore (μm) | Thickness of portion having second pore (μm) | Thickness of porous layer (μm) | Thickness of anodized coating (μm) | Average diameter of first pore (nm) | Average spacing between first pores (nm) | Angle of pore with base material surface (degrees) |
| Example 1 | 20 | 7 | 5 | 12 | 12.02 | 20 | 50 | 60 |
| Example 2 | 18 | 7 | 5 | 12 | 12.02 | 18 | 45 | 60 |
| Example 3 | 16 | 7 | 5 | 12 | 12.02 | 16 | 40 | 60 |
| Example 4 | 15 | 7 | 5 | 12 | 12.02 | 15 | 37.5 | 60 |
| Example 5 | 14 | 7 | 5 | 12 | 12.01 | 14 | 35 | 60 |
| Example 6 | 15 | 7 | 1 | 8 | 8.02 | 15 | 37.5 | 85 |
| Example 7 | 15 | 7 | 4 | 11 | 11.02 | 15 | 37.5 | 60 |
| Example 8 | 15 | 7 | 5 | 12 | 12.02 | 15 | 37.5 | 50 |
| Example 9 | 15 | 8 | 4 | 12 | 12.02 | 15 | 37.5 | 45 |
| Example 10 | 15 | 5 | 1 | 6 | 6.02 | 15 | 37.5 | 60 |
| Example 11 | 20 | 7 | 5 | 12 | 12.02 | 20 | 50 | 60 |
| Example 12 | 14 | 7 | 5 | 12 | 12.01 | 14 | 35 | 60 |
| Example 13 | 12 | 7 | 5 | 12 | 12.01 | 12 | 30 | 60 |
| Example 14 | 10 | 5 | 1 | 6 | 6.01 | 10 | 25 | 45 |
| Example 15 | 14 | 20 | 10 | 30 | 30.01 | 14 | 35 | 55 |
| Example 16 | 18 | 30 | 15 | 45 | 45.02 | 18 | 45 | 65 |

TABLE 3-continued

| Test sample | Anodized coating | | | | | | | |
|---|---|---|---|---|---|---|---|---|
| | Thickness of barrier layer (nm) | Thickness of portion having first pore (μm) | Thickness of portion having second pore (μm) | Thickness of porous layer (μm) | Thickness of anodized coating (μm) | Average diameter of first pore (nm) | Average spacing between first pores (nm) | Angle of pore with base material surface (degrees) |
| Example 17 | 15 | 7 | 5 | 12 | 12.02 | 15 | 37.5 | 60 |
| Example 18 | 15 | 7 | 5 | 12 | 12.02 | 15 | 37.5 | 60 |
| Example 19 | 15 | 7 | 5 | 12 | 12.02 | 15 | 37.5 | 60 |
| Example 20 | 15 | 7 | 5 | 12 | 12.02 | 15 | 37.5 | 60 |
| Example 21 | 15 | 7 | 5 | 12 | 12.02 | 15 | 37.5 | 60 |
| Example 22 | 15 | 7 | 5 | 12 | 12.02 | 15 | 37.5 | 60 |
| Example 23 | 15 | 64.5 | 34.5 | 99 | 99.02 | 15 | 37.5 | 60 |
| Example 24 | 150 | 7 | 5 | 12 | 12.15 | 150 | 375 | 55 |
| Example 25 | 150 | 7 | 5 | 12 | 12.15 | 150 | 375 | 58 |
| Example 26 | 40 | 7 | 5 | 12 | 12.04 | 40 | 100 | 60 |
| Example 27 | 40 | 7 | 5 | 12 | 12.04 | 40 | 100 | 55 |
| Example 28 | 40 | 7 | 5 | 12 | 12.04 | 40 | 100 | 50 |
| Example 29 | 40 | 7 | 5 | 12 | 12.04 | 40 | 100 | 52 |
| Example 30 | 15 | 7 | 5 | 12 | 12.02 | 15 | 37.5 | 55 |
| Example 31 | 15 | 7 | 5 | 12 | 12.02 | 15 | 37.5 | 55 |

TABLE 4

| Test sample | Appearance properties | | |
|---|---|---|---|
| | White color unevenness | Brightness by Hunter | Rating |
| Example 1 | Good | 83 | Good |
| Example 2 | Good | 84 | Good |
| Example 3 | Good | 85 | Good |
| Example 4 | Good | 84 | Good |
| Example 5 | Good | 81 | Good |
| Example 6 | Good | 70 | Good |
| Example 7 | Good | 75 | Good |
| Example 8 | Good | 77 | Good |
| Example 9 | Good | 83 | Good |
| Example 10 | Good | 72 | Good |
| Example 11 | Good | 74 | Good |
| Example 12 | Good | 76 | Good |
| Example 13 | Good | 80 | Good |
| Example 14 | Good | 70 | Good |
| Example 15 | Good | 87 | Good |
| Example 16 | Good | 90 | Good |

TABLE 4-continued

| Test sample | Appearance properties | | |
|---|---|---|---|
| | White color unevenness | Brightness by Hunter | Rating |
| Example 17 | Good | 85 | Good |
| Example 18 | Good | 85 | Good |
| Example 19 | Good | 85 | Good |
| Example 20 | Good | 84 | Good |
| Example 21 | Good | 70 | Good |
| Example 22 | Good | 80 | Good |
| Emmple 23 | Good | 90 | Good |
| Example 24 | Good | 80 | Good |
| Example 25 | Good | 80 | Good |
| Emmple 26 | Good | 82 | Good |
| Example 27 | Good | 82 | Good |
| Example 28 | Good | 81 | Good |
| Example 29 | Good | 81 | Good |
| Example 30 | Good | 85 | Good |
| Example 31 | Good | 85 | Good |

TABLE 5

| Test sample | Anodized coating | | | | | | | |
|---|---|---|---|---|---|---|---|---|
| | Thickness of barrier layer (nm) | Thickness of portion having first pore (μm) | Thickness of portion having second pore (μm) | Thickness of porous layer (μm) | Thickness of anodized coating (μm) | Average diameter of first pore (nm) | Average spacing between first pores (nm) | Angle of pore with base material surface (degrees) |
| Comparative Example 1 | — | — | — | — | — | — | — | — |
| Comparative Example 2 | — | — | — | — | — | — | — | — |
| Comparative Example 3 | 8 | 4 | 1 | 5 | 5.01 | 8 | 20 | 80 |
| Comparative Example 4 | 15 | 15 | 0 | 15 | 15.02 | 15 | 37.5 | 90 |
| Comparative Example 5 | 30 | 3 | 2 | 5 | 5.03 | 30 | 75 | 25 |
| Comparative Example 6 | 22 | 10 | 2 | 12 | 12.02 | 22 | 55 | 88 |
| Comparative Example 7 | 10 | 4 | 0.5 | 4.5 | 4.51 | 10 | 25 | 87 |
| Comparative Example 8 | 10 | 1 | 0.5 | 1.5 | 1.51 | 10 | 25 | 90 |
| Comparative Example 9 | 20 | 10 | 0 | 10 | 10.02 | 20 | 50 | 90 |

TABLE 5-continued

| Test sample | Anodized coating | | | | | | | |
|---|---|---|---|---|---|---|---|---|
| | Thickness of barrier layer (nm) | Thickness of portion having first pore (μm) | Thickness of portion having second pore (μm) | Thickness of porous layer (μm) | Thickness of anodized coating (μm) | Average diameter of first pore (nm) | Average spacing between first pores (nm) | Angle of pore with base material surface (degrees) |
| Comparative Example 10 | 150 | 10 | 0 | 10 | 10.15 | 150 | 375 | 90 |
| Comparative Example 11 | 45 | 10 | 0 | 10 | 10.05 | 45 | 112.5 | 90 |

For the case where no second pore is present, the angle listed in the column headed "Angle of pore with base material surface (degrees)" represents the angle of the first pore.
For the case where second pore is present, the angle listed in the column headed "Angle of pore with base material surface (degrees)" represents the angle of the second pore.

TABLE 6

| Test sample | Appearance properties | | |
|---|---|---|---|
| | White color unevenness | Brightness by Hunter | Rating |
| Comparative Example 1 | Poor | 60 | Poor |
| Comparative Example 2 | Poor | 54 | Poor |
| Comparative Example 3 | Good | 56 | Poor |
| Comparative Example 4 | Good | 60 | Poor |
| Comparative Example 5 | Good | 68 | Poor |
| Comparative Example 6 | Good | 62 | Poor |
| Comparative Example 7 | Good | 65 | Poor |
| Comparative Example 8 | Good | 60 | Poor |
| Comparative Example 9 | Good | 55 | Poor |
| Comparative Example 10 | Good | 60 | Poor |
| Comparative Example 11 | Good | 55 | Poor |

FIGS. 2 and 4 are photographs taken with a SEM of a cross-section and surface of the aluminum member produced in Example 3, respectively. FIG. 3 is a photograph taken with a SEM of the boundary between the anodized coating and base material of the aluminum member produced in Example 3. As shown in FIGS. 2 to 4, it is seen that in the aluminum member of Example 3, the anodized coating 2 is formed on the aluminum base material 1. It is also seen that the first pores 13 and second pores 14 are formed in the anodized coating 2.

In Examples 1 to 31, aluminum members were produced which comprised a base material made of an aluminum alloy and an anodized coating provided on a surface of the base material and having a thickness of 100 μm or less. This anodized coating comprised a barrier layer formed on the surface of the base material and having a thickness of 10 to 150 nm and a porous layer formed on the barrier layer and having a thickness of 6 μm or more, and the porous layer comprised first and second pores. In Examples 1 to 31, each aluminum member was produced by performing anodization on a prepared base material made of an aluminum alloy in an electrolytic solution under conditions where the current density was 5 to 30 $mA \cdot cm^{-2}$ and the temperature of the electrolytic solution was 0 to 80° C., the electrolytic solution comprising sulfuric acid, phosphoric acid, a phosphoric acid salt, oxalic acid, an oxalic acid salt, chromic acid, or a chromic acid salt (a first acid or a salt of the first acid) at a concentration of 0.01 to 2.0 $mol \cdot dm^{-3}$ and diphosphoric acid, triphosphoric acid, or polyphosphoric acid (a second acid being an acid anhydride) at a concentration of 0.01 to 5.0 $mol \cdot dm^{-3}$. In consequence, the aluminum members of Examples 1 to 31 exhibited a high brightness by Hunter and were rated "Good" for white color unevenness.

By contrast, in Comparative Example 1, where the base material was subjected only to alkaline degreasing as a surface treatment using 5 mass % NaOH and was not subjected to anodization, no porous layer was formed, the rating for white color unevenness was "Poor", and the brightness by Hunter was low.

Likewise, in Comparative Example 2, where the sulfuric acid concentration in the electrolytic solution was low, anodization of the base material was not accomplished. Consequently, no porous layer was formed, the rating for white color unevenness was "Poor", and the brightness by Hunter was low.

In Comparative Example 3, where the sulfuric acid concentration in the electrolytic solution was excessively high, both the barrier layer and porous layer were thin; specifically, the thickness of the barrier layer was 8 nm, and the thickness of the porous layer was 5 μm. The brightness by Hunter of the aluminum member of Comparative Example 3 was low, although the rating for white color unevenness was "Good".

In Comparative Example 4, where the diphosphoric acid concentration in the electrolytic solution was low, no second pore was formed in the porous layer, and the brightness by Hunter was low, although the rating for white color unevenness was "Good".

In Comparative Example 5, where the diphosphoric acid concentration in the electrolytic solution was high, the porous layer had a thickness as small as 5 μm, and the brightness by Hunter was low, although the rating for white color unevenness was "Good".

In Comparative Example 6, where the temperature of the electrolytic solution was low, no second pore was formed in the porous layer, and the brightness by Hunter was low, although the rating for white color unevenness was "Good".

In Comparative Example 7, where the temperature of the electrolytic solution was high, the porous layer had a thickness as small as 4.5 μm due to enhanced dissolution of the anodized coating, and the brightness by Hunter was low, although the rating for white color unevenness was "Good".

In Comparative Example 8, where the current density during the anodization was low, the rate of growth of the anodized coating as a whole was slow, the porous layer had a thickness as small as 1.5 μm, and the brightness by Hunter was low, although the rating for white color unevenness was "Good".

In Comparative Examples 9 and 10, where the second acid was not used, no second pore was formed, and the brightness by Hunter was low, although the rating for white color unevenness was "Good".

In Comparative Example 11, where phosphoric acid was used instead of the second acid, no second pore was formed, and the brightness by Hunter was low, although the rating for white color unevenness was "Good".

LIST OF REFERENCE SIGNS

1: base material
2: anodized coating
10: barrier layer
11: porous layer
13: first pore
14, 14*a*, 14*b*, 14*c*, 14*d*, 14*e*, 14*f*: second pore

What is claimed is:

1. An aluminum member comprising:

a base material made of aluminum or an aluminum alloy; and an anodized coating provided on a surface of the base material and having a thickness of 100 μm or less, wherein the anodized coating comprises a barrier layer formed on the surface of the base material and having a thickness of 10 to 150 nm, wherein the barrier layer includes a first surface adjacent to the base material and a second surface opposite the first surface, and a porous layer formed on the second surface of the barrier layer and having a thickness of 6 μm or more, and the porous layer comprises a plurality of first pores extending in a thickness direction of the porous layer from the second surface of the barrier layer between the porous layer and the barrier layer toward a surface of the porous layer opposite the second surface of the barrier layer; and a plurality of second pores connected to the plurality of first pores and extending so as to branch radially in the thickness direction of the porous layer toward the surface of the porous layer, an angle of the plurality of second pores with the surface of the base material being 30 to 85 degrees, wherein the anodized coating is white and comprises an aluminum oxide, and wherein a brightness by Hunter of the aluminum member, as measured from a surface of the anodized coating, is 70 to 90.

2. The aluminum member according to claim 1, wherein an average diameter of the plurality of first pores is 10 to 150 nm, and an average spacing between individual ones of the plurality of first pores adjacent to each other is 25 to 400 nm.

3. A method of manufacturing an aluminum member, wherein the aluminum member comprises a base material made of aluminum or an aluminum alloy, and an anodized coating provided on a surface of the base material and having a thickness of 100 μm or less, the anodized coating comprises a barrier layer formed on the surface of the base material and having a thickness of 10 to 150 nm, wherein the barrier layer includes a first surface adjacent to the base material and a second surface opposite the first surface, and a porous layer formed on the second surface of the barrier layer and having a thickness of 6 μm or more, and the porous layer comprises a plurality of first pores extending in a thickness direction of the porous layer from the second surface of the barrier layer between the porous layer and the barrier layer toward a surface of the porous layer opposite the second surface of the barrier layer; and a plurality of second pores connected to the plurality of first pores and extending so as to branch radially in the thickness direction of the porous layer toward the surface of the porous layer, an angle of the plurality of second pores with the surface of the base material being 30 to 85 degrees, wherein the anodized coating is white and comprises an aluminum oxide, and wherein a brightness by Hunter of the aluminum member, as measured from a surface of the anodized coating, is 70 to 90, the method comprising:

preparing the base material made of aluminum or an aluminum alloy; and performing anodization on the base material in an electrolytic solution under conditions where a current density is 5 to 30 $mA \cdot cm^{-2}$ and a temperature of the electrolytic solution is 0 to 80° C., the electrolytic solution comprising: a first acid or a salt of the first acid at a concentration of 0.01 to 2.0 $mol \cdot dm^{-3}$, the first acid being selected from a group consisting of an inorganic acid and an organic carboxylic acid; and a second acid at a concentration of 0.01 to 5.0 $mol \cdot dm^{-3}$, the second acid being at least one acid anhydride selected from a group consisting of diphosphoric acid, triphosphoric acid, and polyphosphoric acid.

4. The aluminum member according to claim 1, wherein the anodized coating is opaque.

* * * * *